United States Patent [19]

Kurt

[11] Patent Number: 4,719,670

[45] Date of Patent: Jan. 19, 1988

[54] SKI BOOT

[75] Inventor: Hilgarth Kurt, Graz, Austria

[73] Assignee: Skischuhfabrik Dynafit Gesellschaft m.b.H., Graz, Austria

[21] Appl. No.: 927,072

[22] Filed: Nov. 5, 1986

[30] Foreign Application Priority Data

Nov. 14, 1985 [AT] Austria ..... 3322/85

[51] Int. Cl.[4] ..... A43C 11/00; A44B 21/00; A43B 5/00

[52] U.S. Cl. ..... 24/71.2; 36/119; 36/50; 24/68 SK

[58] Field of Search ..... 36/117–121, 36/50; 24/68 B, 71.2, 68 SK, 69 SK, 70 SK, 71 SK

[56] References Cited

U.S. PATENT DOCUMENTS

| | | | |
|---|---|---|---|
| 4,574,500 | 3/1986 | Aldinio et al. | 36/119 |
| 4,616,524 | 10/1986 | Bidoia | 36/119 X |
| 4,620,379 | 11/1986 | Sartor | 36/119 |
| 4,633,599 | 1/1987 | Morell et al. | 36/50 |
| 4,653,204 | 3/1987 | Morell et al. | 36/117 |
| 4,660,300 | 4/1987 | Morell et al. | 36/119 X |

FOREIGN PATENT DOCUMENTS

| | | | |
|---|---|---|---|
| 0132744 | 2/1985 | European Pat. Off. | 36/117 |
| 0157118 | 10/1985 | European Pat. Off. | 36/117 |
| 2570257 | 3/1986 | France | 36/117 |
| 2572258 | 5/1986 | France | 36/119 |

*Primary Examiner*—James Kee Chi

*Attorney, Agent, or Firm*—Fleit, Jacobson, Cohn & Price

[57] ABSTRACT

A ski boot having a foot receiving casing and a leg portion, as well as a pressure distribution plate which is disposed between casing and an inner boot portion inserted in the casing, and which plate is provided with a device which presses the pressure distribution plate towards the instep region. The pressure distribution plate is under the influence of a device which presses the plate against the instep of the foot, so that the plate abuts substantially the entire instep and is pulled towards the heel of the foot.

8 Claims, 12 Drawing Figures

SKI BOOT

The invention relates to a ski boot having a casing or shell and a leg portion, more especially a ski boot which may be put-on by entering the boot from the rear, and wherein the leg portion comprises a sleeve, which forms the front portion thereof, and a closure or cover, which forms the rear portion thereof, as well as a means for securing the leg portions together in the position of use, a pressure distribution plate being disposed inside the casing, preferably between the casing and inner boot portion, and said pressure distribution plate extends at least over the instep region, preferably to the front part of the foot, and at least partially laterally surrounds the foot, the pressure distribution plate on both sides of the foot being effectively connected to a pulling or pushing component which exerts a force, acting towards the sole, on the pressure distribution plate and is actuable from outside the boot by means of a tensioning device.

Numerous pressure distribution plates of this type are already known. for example, German Auslegeschrift No. 1 806 109 discloses a pressure distribution plate which corresponds to the shape of the front part of the foot and can be brought closer to the sole to a greater or lesser extent in conformity with the size and shape of the foot by means of a screw connection mounted in the front foot region of the shell, thereby permitting the pressure exerted on the foot to be regulated.

German Offenlegungsschrift No. 2 511 605 discloses a pressure distribution plate which, by means of two screws, is displaceable away from, or towards, the instep of the foot which has been inserted into the ski boot in order to optimise the seating of the ski boot on the foot. In such a case, the screws are screwably/screw-connectably mounted in the instep portion of the casing.

Finally, German Offenlegungsschrift No. 2 709 694 discloses ski boots wherein, for the support of the front part of the foot, pressure distribution plates are pressed against the front part of the foot by means of straps which, due the influence of a tensioning device, exert a pressure on the upper turning point of the pressure distribution plate.

All the known arrangements are disadvantageous because the pressure distribution plate exerts a pressure only on the upper turning point of the front part of the foot, with the result that the front part of the foot is only retained in an inadequate manner and, in addition, the skier suffers unpleasant pressure on the front part of the foot.

The present invention seeks to provide measures whereby the disadvantage of the known arrangement is overcome, and whereby the pressure exerted on the instep and/or front part of the foot extends substantially over the entire cross-sectional area of the pressure distribution plate.

With a ski boot of the above-mentioned type, this object is achieved, according to the invention, in that the pushing or pulling component is a Bowden cable with a sleeve or sheath which is supported, at least at one end, on the pressure distribution plate or on the casing or a component connected thereto. As a result of this measure, the pressure distribution plate transmits a uniform pressure to the instep of the skier over the entire cross-sectional area thereof, thereby achieving optimum support for the front part of the foot in the ski boot without the skier experiencing undesirable local pressures there.

According to a further feature of the invention, the pushing or pulling component comprises a cable wire or strap or band wire which has a point of securement on flaps of the pressure distribution plate, which flaps are provided on each side of the instep or front part of the foot, preferably in the region of the lower edges thereof.

The pushing or pulling component is preferably a Bowden cable with a sheath which, on the one hand, is supported or secured on the pressure distribution plate and, on the other hand, is supported or secured on the casing or component connected thereto.

A preferred embodiment of the tensioning device resides in the fact that at least one cable reel is mounted in a bearing bush by means of a bearing shaft or bolt so as to be rotatable and axially displaceable; that the bearing bush forms the rotary member of a freewheel bearing which has a rigid bearing connected to the housing of the tensioning device; that one end of the bearing bush is connected to the cable reel via an engageable and disengageable coupling means; and that the other end of the bearing bush is connected to a tensioning disc via a locking coupling means which is operational in only one direction of rotation, and said tensioning disc is provided with a rotary knob, a tensioning lever, or the like; the bearing bolt extending through the tensioning disc and being connected, at its end, to a resilient component which is supported on the tensioning disc, so that the engageable and disengageable coupling means for tensioning the cable wire or band wire is engaged, and it is disengageable by the axial displacement of the bearing bolt in a direction opposite to the force of the resilient component.

The invention will be described further by way of example, with reference to the accompanying drawings, in which.

Figure 1:
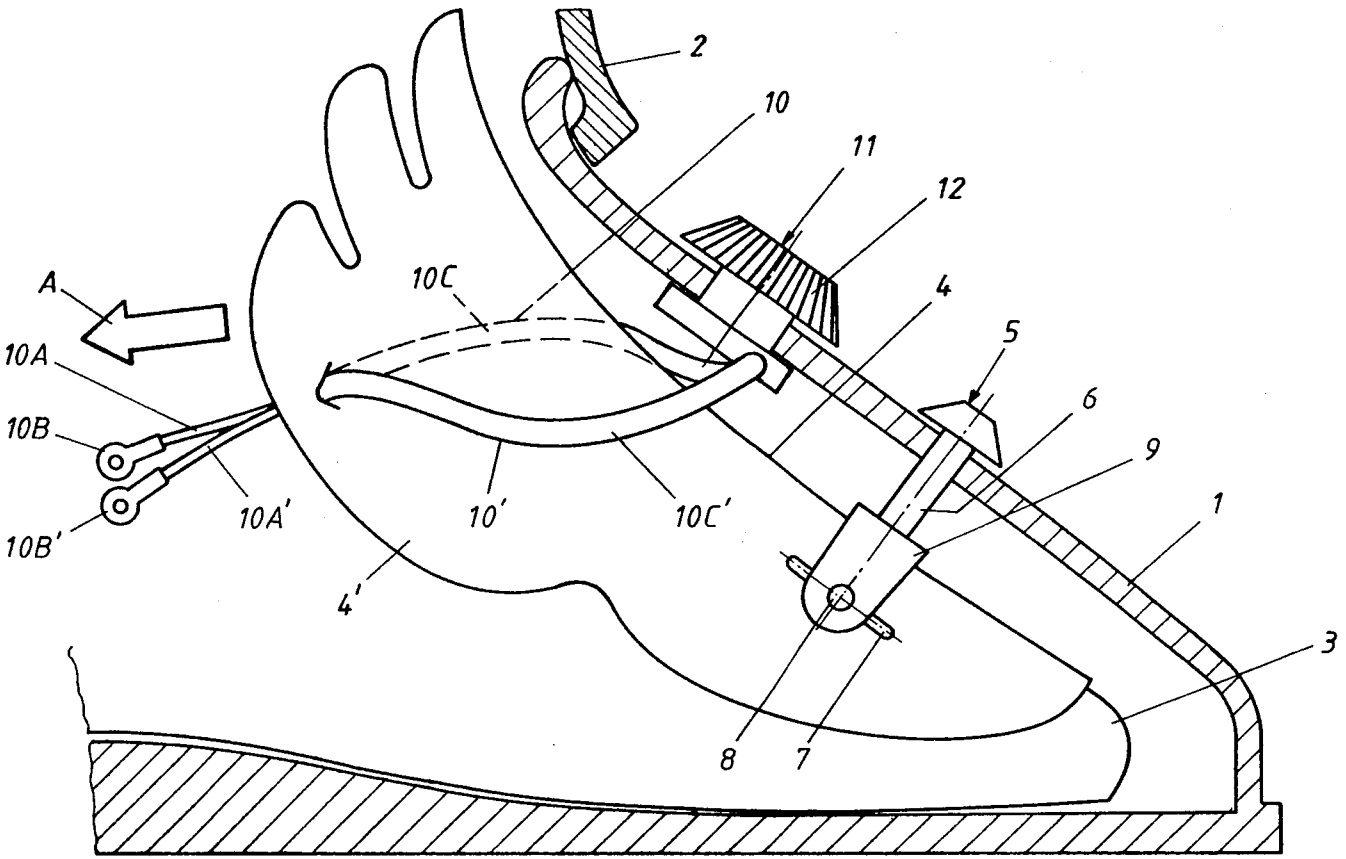
FIG. 1 illustrates a first embodiment of the invention including a ski boot provided with two cable.

FIG. 1 illustrates a foot receiving shell or casing 1 and a leg portion 2 which is connected to the casing 1 in a manner known per se. e.g. in a pivotal manner. An inner boot portion 3 is inserted in the outer boot portion, which comprises casing 1 and leg portion 2, and the skier inserts his foot into said inner boot portion. A pressure distribution plate 4 is provided between the casing 1 and the inner boot portion 3 and extends over the instep and the front part of the foot substantially to the toe region. At its front end, the pressure distribution plate 4 is pivotally connected to a means 5 for adjusting the front part of the foot, so that the pressure distribution plate 4 is pivotable about the point of attachment with the means 5 for adjusting the front part of the foot in a direction towards, and away from, the sole of the boot. The means 5 for adjusting the front part of the foot is so adapted that the pressure distribution plate 4 is pressed against the front part of the foot by means of a threaded bolt 6 or is displaceable away from said front part of the foot. In addition, the pressure distribution plate 4 is also longitudinally displaceable in slots 7 which are provided on either side of said plate, a bolt 8 of each leg of a U-shaped strap 9 engages in each slot 7 and being connected to the threaded bolt 6.

In order to press the pressure distribution plate 4 over the whole or substantially the whole of its cross-section against the instep portion of the inner boot portion, a means is provided which, as a result of the push and pull action on the lateral edge portions of the pressure distribution plate 4 or on its lateral flaps 4', produces a uniform pressure over the whole extent of the pressure distribution plate 4 lying at right angles to the direction of movement, so that said plate, over the whole abovementioned extent, abuts against the instep region of the foot, i.e. of the inner boot portion, and hence transmits a pressure over most of the cross-sectional area in a direction towards the heel, as indicated by arrow A.

In the embodiment of the means for adjusting the instep as shown in FIG. 1, two Bowden cables 10 and 10' are provided, and the wires 10A and 10A' of such cables are secured at their sole ends to the lateral walls of the casing 1 by means of lugs 10B and 10B', whereas the other ends of the cables 10 and 10' are connected to a tensioning device 11 which is described more fully hereinafter and has a rotary knob 12 which, when rotated, causes the wires 10A and 10A' to be wound-up in the tensioning device The sheaths 10C and 10C' of the Bowden cable 10 and 10' extend above the pressure distribution plate 4 and are supported at the plate end close to the lateral edge and in the instep region on the outer surface of the pressure distribution plate 4, whereas the other ends of the sheaths 10C and 10C' are supported in the region of the tensioning device 11. Winding-up of the wires 10A and 10A' by means of the rotary knob 12 shortens the length of the portions of wires 10A and 10A' situated below the pressure dsitribution plate 4, whereby the sheaths 10C and 10C' press the pressure distribution plate 4, in the direction of arrow A, against the instep of the foot of the skier, i.e. against the inner boot portion 3, so that the pressure distribution plate 4 rotates about the bolts 8 until it abuts fully against the instep of the inner boot portion 3 and exerts a uniform pressure on said portion 3 around the instep.

Figure 2:
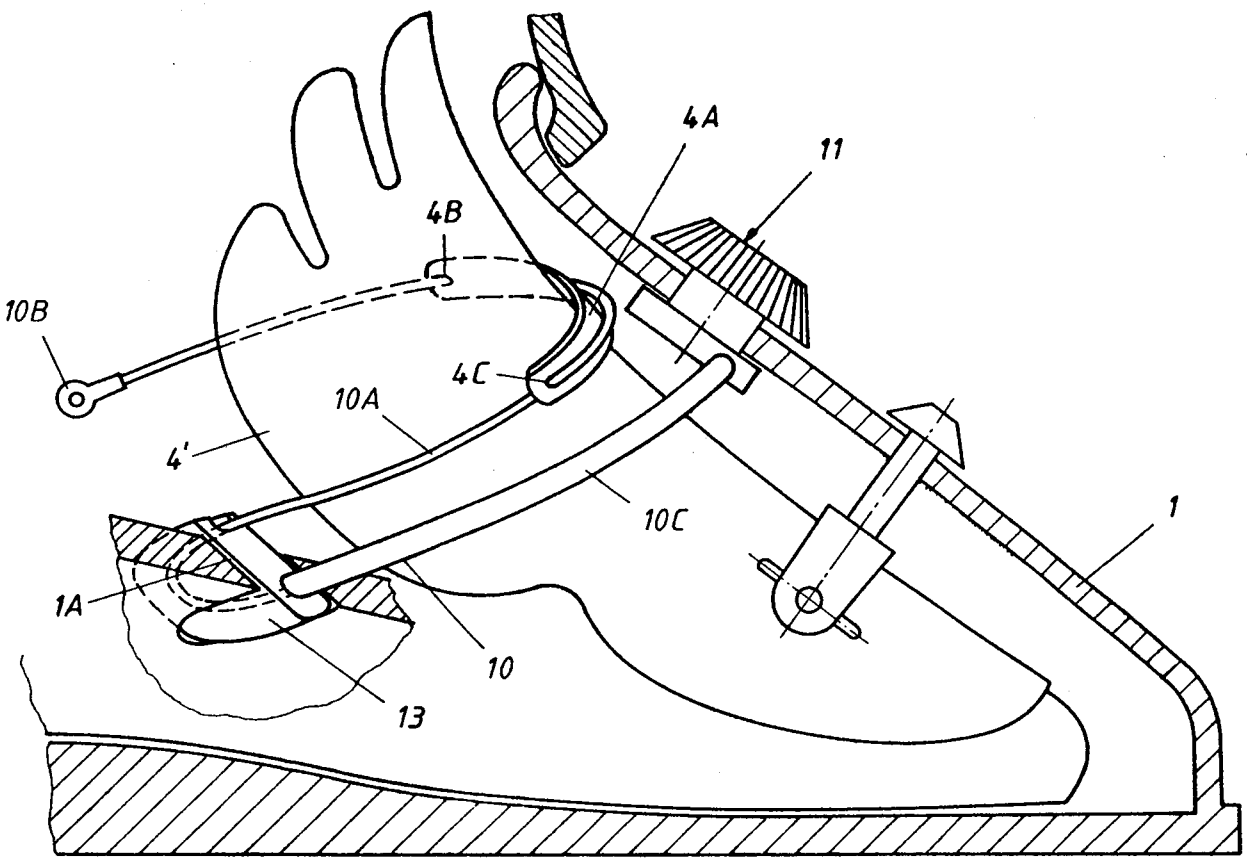
FIGS. 2 to 4 show modifications of the embodiment of FIG. 1 and of a ski boot provided with one cable.
Figure 3:
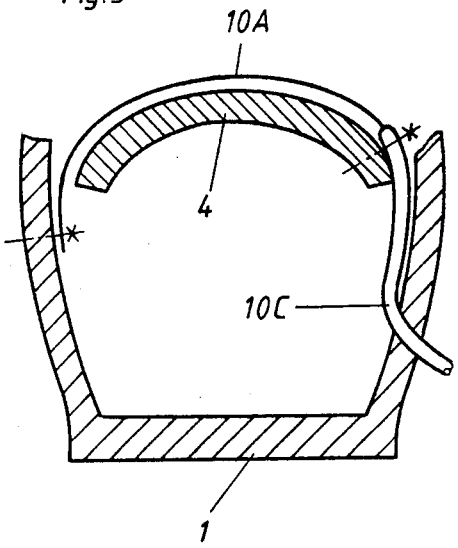
Figure 4:
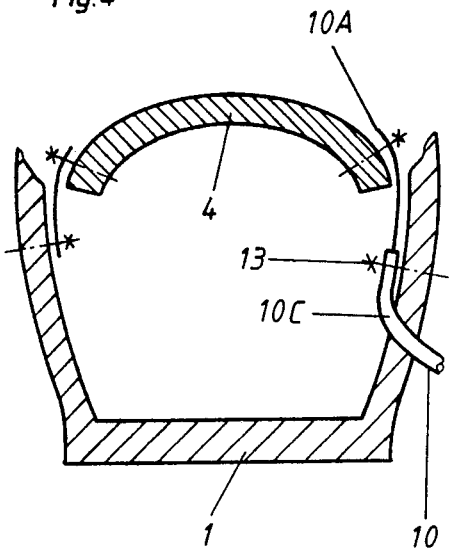

In the embodiments shown in FIGS. 2 to 4, only one single Bowden cable 10 is provided having a wire 10A which is placed over the pressure distribution plate 4 and is secured at its free end to the casing 1 by means of the lug 10B, whereas the other end is connected to the tensioning device 11, as in the preceding embodiment. In the embodiment of FIG. 2, the cable sheath 10C extends with one of its ends in a slot 1A, which is provided in the lateral wall of the casing 1, and through a bearing block 13 which is secured by means of screws or rivets and serves as the turning point for the wire 10A; said bearing block simultaneously leading the Bowden cable out of the casing 1. For this purpose, the slot 1A and accordingly the bearing block 13 also extend outwardly from the inside in an inclined manner towards the tip of the casing. The other end of the cable sheath 10C extends to a second support point in the region of the tensioning device 11. When the wire 10A is wound-up, it transmits a uniform pressure to the pressure distribution plate 4, so that said plate lies fully around the instep of the inner boot portion, as in the preceding case. A resilient safety lug 4A may be placed over the turning point of the pressure distribution plate 4, such a lug having a respective hole 4B and 4C at each of its two ends. The wire 10A extends through the two holes 4B and 4C so that, as a result of its rigidity, the wire is situated at a distance a from the safety lug 4A. This is advantageous in that, in the event of a sudden impact, the wire 10A does not influence the ankle-joint to such a considerable extent that the joint could break. Instead, the increase in pressure in the wire 10A, caused by the sudden impact, is gradually transmitted to the pressure distribution plate 4.

In the embodiment of FIG. 1, bearing blocks 13 of the described construction may also be provided at the connection points X of the flaps 4' of the pressure distribution plate 4, and the bearing blocks may be injection-moulded or cast from plastics material jointly with the pressure distribution plate.

Figure 8:
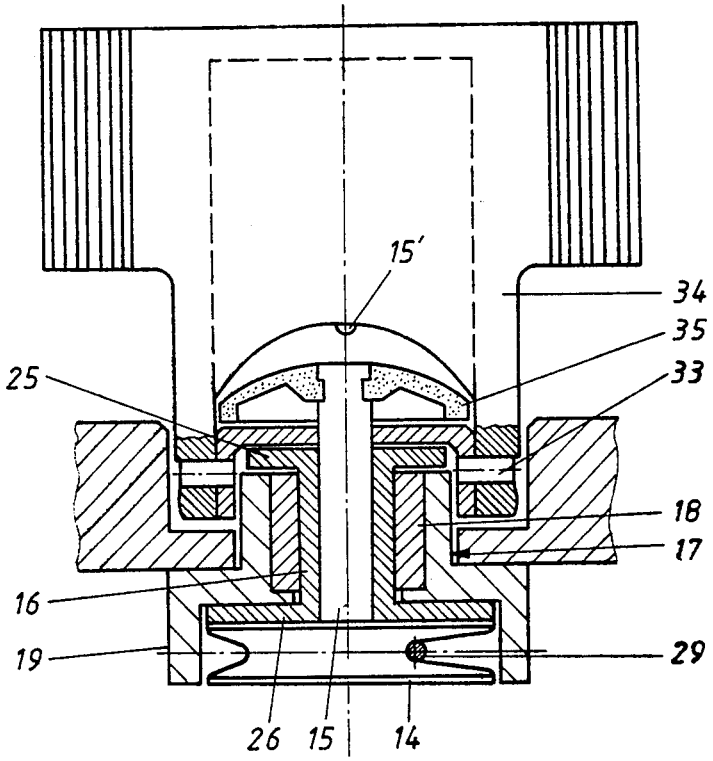
FIG. 8 is a cross-sectional view through a tensioning device of the invention.

The embodiment of FIG. 3 is similar to that of FIGS. 2 and 8, except that the cable sheath 10C is not connected to a bearing block of the casing 1, but is connected to the edge of the pressure distribution plate 4 remote from the point of securement of the wire 10A on the inside/inner surface of the casing 1.

In the embodiment of FIG. 4, the end of the wire 10A of the Bowden cable 10 remote from the tensioning device 11 is connected to the edge situated nearest the Bowden cable 10 and, as in the embodiment of FIGS. 2 and 8, the end of the cable sheath 10C is connected to a bearing 13. The edge of the pressure distribution plate 4 remote from the Bowden cable is connected to the inside of the casing 1.

Figure 5:
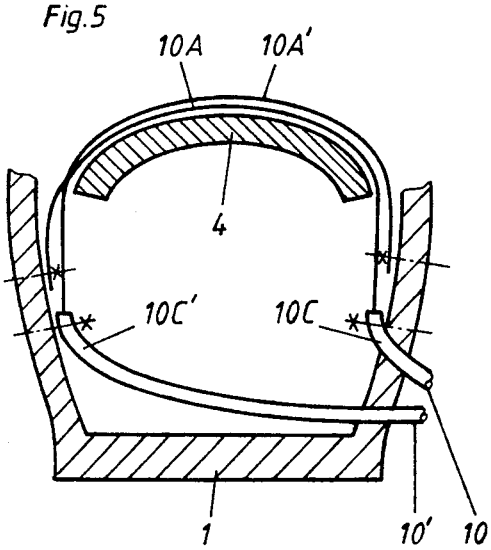
FIGS. 5 to 7 show modifications of ski boots provided with two cables.
Figure 6:
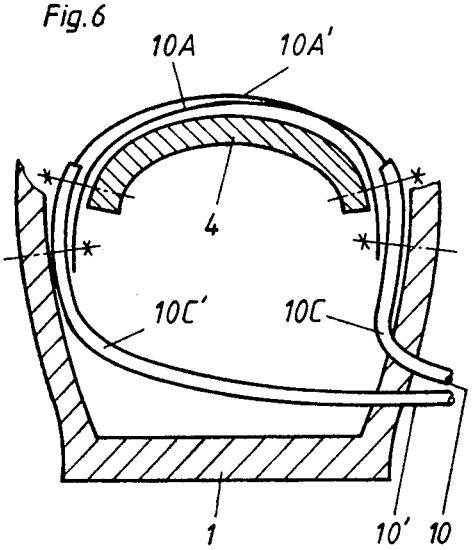
Figure 7:
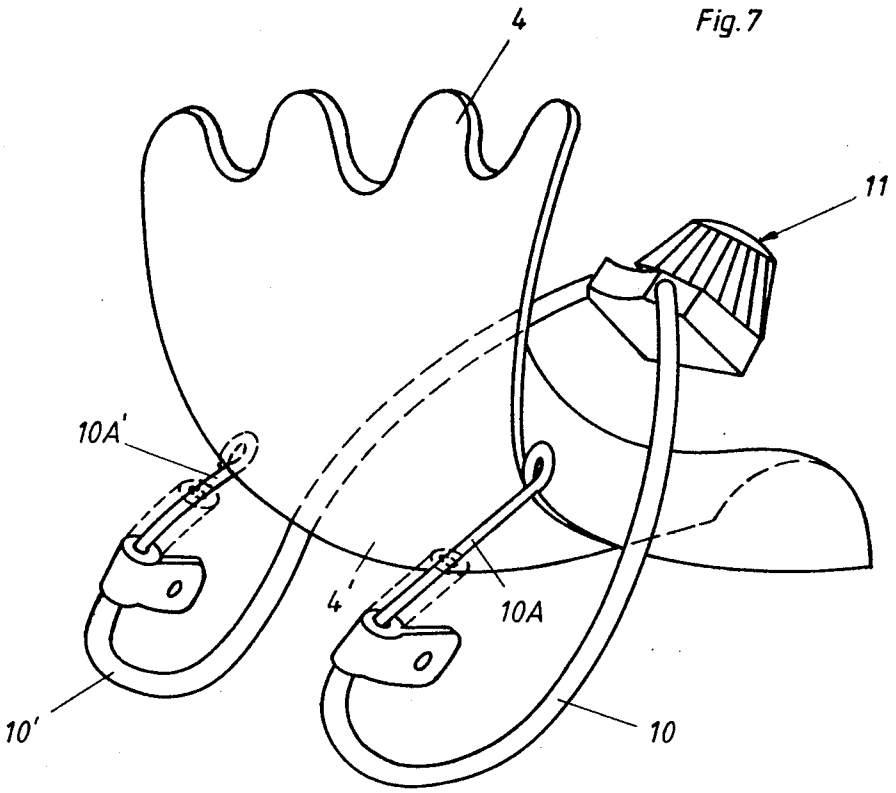

In the embodiments of FIGS. 5 to 7, two Bowden cables 10 and 10' are provided in each case, and the cable sheaths 10C and 10C' of said wires are secured, opposite each other, to the inside of the casing 1. Each of the wires 10A and 10A', coming from the end of the sheath, is placed over the pressure distribution plate 4 and secured to the inner surface of the casing 1 remote from the associated end of the sheath.

The embodiment of FIG. 6 is similar to that of FIG. 5, except that the ends of the cable sheaths 10C and 10C' are not secured to the casing 1, but they are secured to the lateral edges of the pressure distribution plate 4.

FIG. 7 illustrates a similar embodiment to that of FIG. 1, except that each of the two edges of the flaps 4' of the pressure distribution plate 4 is connected to a respective wire 10A or 10A' of a Bowden cable 10 or 10'. As in the embodiment of FIG. 2, the cable sheaths 10C and 10C' extend, with their ends facing the pressure distribution plate 4, into bearing blocks 13 and 13', respectively, which are secured in the lateral wall of the shell 1.

The arrangement according to the invention permits the plate to be produced from resilient material, with the result that the plate can abut against the foot sufficiently In known arrangements, it was necessary for the plate to be reinforced at least in the region of the turning point, or it was necessary for the entire plate to be produced from rigid material in order to transmit the pressure.

Various structural modifications may of course be made within the scope of the invention in respect of the shape, length and material of the pressure distribution plate 4.

A relatively solid, flexible and preferably resilient material, such as plastics material or metal, is generally used for the pressure distribution plate 4.

It is also possible for the tensioning device to be disposed in the sole of the ski boot, so that there is no need for any deflection means.

Figure 10:
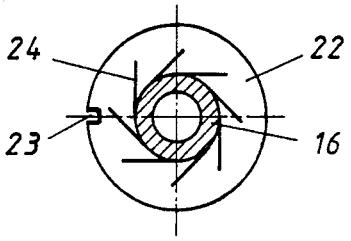
FIGS. 10 and 11 show examples of a freewheel bearing for the tensioning device.
Figure 11:
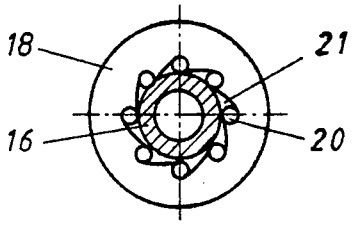
Figure 9:
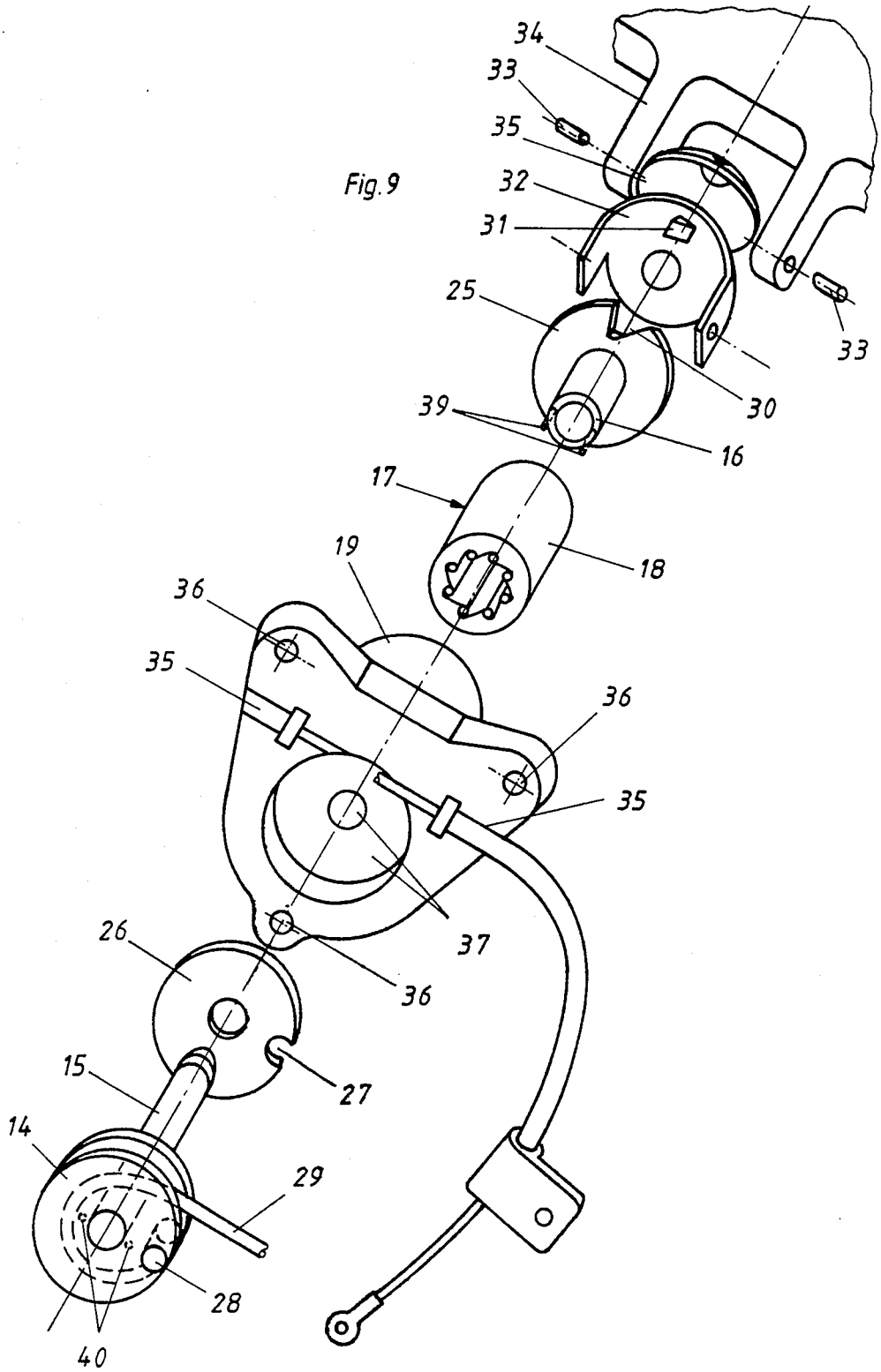
FIG. 9 is an exploded view of the tensioning device of FIG. 8.

The tensioning device of FIGS. 9 and 10 includes a cable reel or drum 14 for the cable wire which is to be wound-up, e.g. a Bowden cable. The cable reel 14 is rigidly connected to a bearing bolt 15 which is mounted in a bearing bush 16 so as to be rotatable and axially displaceable. The bearing bush 16 forms the rotatable component of a freewheel bearing 17 which has a stationary or rigid bearing 18 securely connected to a housing 19 of the tensioning device as a result of being pressed in position or glued. As known per se with a freewheel bearing, cylindrical rollers 20 are disposed between the bearing bush 16 and the bearing 18, and such rollers permit the bearing bush 16 to rotate in one direction of rotation. In the other direction of rotation, however, the rollers 20 become wedged in tapering recesses 21 formed in the bearing 18 and thus prevent the bearing bush 16 from rotating (FIG. 11). Instead of employing the cylinderical rollers and the specially shaped recesses in the bearing 18, a plurality of discs 22 formed from plastics material may be inserted, for example, in the recess in the housing 19 for the bearing 18 in a non-rotatable manner, e.g. by means of a groove 23. Such discs have radial, but inclined slots 24 on the inner surface so that the same effect can thus be achieved (FIG. 10).

The upper end of the bearing bush 16 is rigidly connected to a follower disc 25, and the lower end is rigidly connected to a follower disc 26 (in the view shown in FIG. 9, only the connection between the entrainer disc 25 and the bearing bush 16 is shown). The lower disc 26 has a radial, circular recess 27 for receiving a nipple 28 which, in turn, is mounted in a suitable recess in the cable reel 14. Said nipple is connected to the end of the wire 29 of the tensioning device and protrudes laterally from the cable reel 14. The upper follower disc 25 is provided with at least one recess 30. At least one nose portion or projection member 31, which extends inclinedly downwardly, of a tensioning disc 32 which abuts against the upper entrainer disc 25 engages in the recess 30, and a tensioning lever 34 is pivotably secured to said tensioning disc via a respective rotary journal 33. The bearing bolt 15 extends through the tensioning disc 32 and is connected, at its upper end, to a resilient member 35 which, for example, is in the form of a spring cap, a compression spring, a cup spring or the like, and is supported on the tensioning disc 32.

In the resilient member 35, i.e. at the end of the bearing bolt 15, a recess 15' is preferably provided which advantageously permits a pointed object, e.g. the tip of a ski stick, to be inserted therein. The housing 19 is provided with apertures or recesses 35 for receiving the sheaths of the Bowden cable and with bores 36 for securing the housing 19, for example, to the casing of the ski boot as well as with a central, continuous aperture 37 which is adapted to the shape of the cable reel 14, the bearing bolt 15 and the bearing 17 for receiving such component parts in the housing 19.

To actuate the tensioning device, the tensioning lever 34 is pivoted out of its substantially horizontal initial position from a suitably shaped recess in the housing 19, or respectively in the subsequent region of the casing, into a substantially vertical position and is rotated (e.g. in a clockwise direction) until the desired tensioning effect is achieved. In such a case, the force is transmitted from the projection member 31 of the tensioning disc 32 via the upper entrainer disc 25, the bearing bush 16, the lower entrainer disc 26 and the nipple 28 to the cable reel 14. If the tensioning lever 34 is subsequently released, the freewheel bearing 17 prevents the component parts 14, 15, 16, 25 and 26 from turning back. However, the tensioning lever 34 may be rotated in the opposite direction back into its rest position and pivoted in position, since the projection member 31 can disengage from the recess 30 in the upper entrainer disc 25 and, as a consequence thereof, it permits the tensioning disc 32 to be rotated in the opposite direction. Conversely, if it is desired to reduce or eliminate the tensioning effect, only a pressure from above, e.g. with the tip of the ski stick, needs to be exerted on the resilient member 35, whereby the bearing bolt 15 is displaced, together with the cable reel 14, until the nipple 28 disengages from the appropriate recess 27 in the lower entrainer disc 26, and whereby the cable reel 14 can rotate freely until the desired tension-relieving effect is achieved, whereupon no more pressure needs to be exerted on the resilient member 35. For renewed tensioning, the tensioning lever 34 is again pivoted out of position and rotated for such time until the nipple 28 engages automatically in the recess 27, and the tensioning process may be continued.

Figure 12:
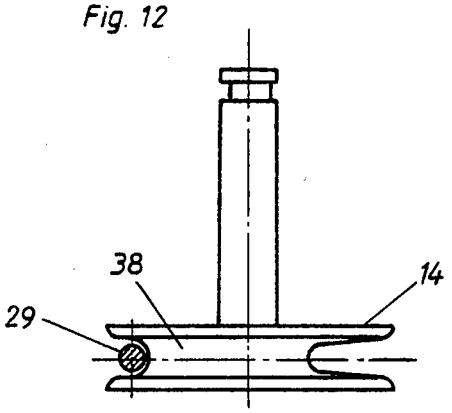
FIGS. 12 and 13 show example of a cable reel for the tensioning device.
Figure 13:
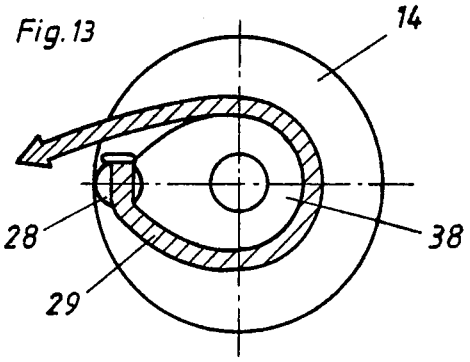

FIGS. 12 and 13 illustrate an embodiment of the cable reel 14 wherein the core 38, onto which the end of the cable wire 29 is wound, has a shape which differs from the circular shape and is preferably pear-shaped. This special configuration of the core 38 permits a relatively long cable run to be achieved at the beginning of the tensioning process with a relatively low tensile force on the cable wire, whereas a relatively short cable run is achieved towards the end of the tensioning process with a relatively large tensile force on the cable wire.

In the embodiment shown in FIGS. 9 and 10, the entrainer or follower disc 26 forms an engageable and disengageable coupling means with its recess 27 together with the nipple 28 in the cable reel 14. In a further variation of this coupling means, two journals 39 are disposed, for example, on the end of the bearing bush 16 and engage in corresponding bores 40 formed in the cable reel 14, as shown in FIG. 9 by dotted lines, and the entrainer disc 26 would not be necessary in such a case.

The entrainer disc 25 forms a locking coupling means with its recess 30 together with the projection member 31 of the tensioning disc 32, and such a coupling means only transmits a torque in one direction of rotation. The locking coupling means could also be formed by the position of a nose portion at the end of the bearing bush 16, which nose portion would engage in a recess formed in the tensioning disc 32 (such an engagement not being shown), and the entrainer disc 25 would not be necessary in such case.

In the example shown in FIG. 9, the recesses 35' for receiving the sleeves or sheaths of the Bowden cable are provided in a substantially horizontal manner, so that the cable wire may be selectively inserted either from the left or from the right.

If two or more Bowden cables are used instead of a single Bowden cable, and if they are to be simultaneously actuated by the tensioning device, such Bowden cables may either be radially distributed over a suitable number of apertures in the housing 19 or be inserted so as to lie adjacent one another, whereby either a wider cable reel is used or a plurality of cable reels, which are connected to the bearing bolt 15, are used.

I claim:

1. A tensioning device for a cable wire or band wire for utilisation in a ski boot having a casing and a leg portion, more especially a ski boot which is put on by entering the boot from the rear, and wherein the leg portion comprises a sleeve, which forms the front portion thereof, and a cover, which forms the rear portion thereof, as well as a means for securing the leg portions together in the position of use, a pressure distribution plate being disposed inside the shell, preferably between the casing and an inner boot portion, and said pressure distribution plate extends at least over the instep region, preferably to the front part of the foot, and laterally surrounds the foot at least partially;

the tensioning device including at least one cable reel mounted in a bearing bush by means of a bearing bolt so as to be rotatable and axially displaceable;

wherein the bearing bush forms the rotary member of a freewheel bearing which has a rigid bearing sleeve surrounding the bearing bush and connected to the housing of the tensioning device with wedge locking means operative between the bearing bush and the sleeve for permitting unlimited rotation of the bush in the sleeve in a cable reel-tensioning direction and locking the sleeve against rotation in the bush in a cable reel-relaxing direction;

wherein one end of the bearing bush is connected to the cable reel via an engageable and disengageable coupling means; and wherein the other end of the bearing bush is connected to a tensioning disc provided with a rotary knob, a tensioning lever or the like, the bearing bolt extending through the tensioning disc and being connected to a resilient member which is supported on the tensioning disc, the resilient member biasing the engageable and disengageable coupling means into an engaged condition for tensioning the cable reel the coupling means being disengageable by the axial displacement of the bearing bolt in a direction opposite the force of the resilient member.

2. A tensioning device as claimed in claim 1, wherein the engageable and disengageable coupling means is in the form of a first entrainer disc which is connected to the bearing bush and has a recess for receiving a nipple which protrudes laterally from the cable reel and is mounted in a recess in the cable reel, said nipple being connected to the end of a cable wire or band wire.

3. A tensioning device as claimed in claim 1, wherein the engageable and disengageable coupling means comprises at least one journal which lies axially remote from the bearing bush and engages in at least one bore formed in the cable reel.

4. A tensioning device as claimed in claim 1, wherein the locking copuling means is in the form of a second entrainer disc which is connected to the bearing bush and has at least one recess for receiving at least one projection member which extends inclinedly from the tensioning disc relative to the second entrainer disc.

5. A tensioning device as claimed in claim 1, wherein the resilient member is in the form of a spring cap, a compression spring, a cup spring or the like.

6. A tensioning device as claimed in claim 1, wherein the tensioning lever is pivotably connected to the tensioning disc via rotary journals.

7. A tensioning device as claimed in claim 1, wherein the cable reel has a core, on which a cable wire or band wire is wound, the core having at least partially a cross-sectional shape which differs from the circular shape.

8. A tensioning device as claimed in claim 7, wherein the cross-section of the core is pear-shaped.

* * * * *